US007322114B2

(12) United States Patent
Kawamura

(10) Patent No.: US 7,322,114 B2
(45) Date of Patent: Jan. 29, 2008

(54) SAW CHAIN TENSIONING MECHANISM

(75) Inventor: Kunimune Kawamura, Fuchu (JP)

(73) Assignee: Kioritz Corporation, Tokyo (JP)

( * ) Notice: Subject to any disclaimer, the term of this patent is extended or adjusted under 35 U.S.C. 154(b) by 0 days.

(21) Appl. No.: 11/167,128

(22) Filed: Jun. 28, 2005

(65) Prior Publication Data

US 2006/0000098 A1 Jan. 5, 2006

(30) Foreign Application Priority Data

Jul. 1, 2004 (JP) ..... 2004-195668

(51) Int. Cl.
*B27B 17/14* (2006.01)

(52) U.S. Cl. ..... 30/386; 30/383

(58) Field of Classification Search ..... 30/381, 30/382, 383, 384, 386
See application file for complete search history.

(56) References Cited

U.S. PATENT DOCUMENTS

| | | | | |
|---|---|---|---|---|
| 3,194,284 | A * | 7/1965 | Walker | 30/386 |
| 3,866,320 | A * | 2/1975 | Progl | 30/386 |
| 4,835,868 | A * | 6/1989 | Nagashima | 30/386 |
| 4,999,918 | A * | 3/1991 | Schliemann et al. | 30/386 |
| 5,528,835 | A * | 6/1996 | Ra | 30/386 |
| 6,049,986 | A * | 4/2000 | Calkins et al. | 30/386 |
| 6,061,915 | A * | 5/2000 | Seigneur et al. | 30/386 |
| 6,493,949 | B2 * | 12/2002 | Kondo et al. | 30/386 |
| 6,564,459 | B1 * | 5/2003 | Steinbrueck et al. | 30/386 |

FOREIGN PATENT DOCUMENTS

| | | |
|---|---|---|
| DE | 198 05 821 | 8/1998 |
| DE | 10124080 | 2/2002 |
| JP | 10-286802 | 10/1998 |
| JP | 2001328101 | 11/2001 |
| WO | WO 01/49465 | 7/2001 |

OTHER PUBLICATIONS

Widmaier, German Office Action, Feb. 22, 2006, File No. 10 2005 030 390.0-15, Germany.

* cited by examiner

*Primary Examiner*—Hwei-Siu C. Payer
(74) *Attorney, Agent, or Firm*—Nixon Peabody LLP; Donald R. Studebaekr

(57) ABSTRACT

A saw chain tensioning mechanism for adjusting the tension in a saw chain extending around a chain guide plate includes a threaded rod member disposed adjacent to a rear end of the chain guide plate and along the longitudinal direction of the chain guide plate, a movable member engaged with the chain guide plate and adapted to be moved along the threaded rod member by a rotation of the threaded rod member, and a driving gear integral with the threaded rod member. The tensioning mechanism includes a driving gear for rotatively driving the driving gear and an operating member for manually rotating the driving gear. Manipulating the operating member changes the longitudinal position of the chain guide plate and correspondingly causes a change in a tension of the saw chain.

9 Claims, 6 Drawing Sheets

Related Art

SAW CHAIN TENSIONING MECHANISM

BACKGROUND OF THE INVENTION

1. Field of the Invention

The present invention relates to a tensioning mechanism, and more particularly to a saw chain tensioning mechanism for changing a longitudinal position of a chain guide plate of a chain saw relative to a main body case of the chain saw to adjust a tension of a saw chain wound around the chain guide plate 2. Description of the Related Art As one type of saw chain tensioning mechanism, there has heretofore been known a saw chain tensioning mechanism as disclosed, for example, in Japanese Patent Laid-Open Publication No. 10-286802. FIG. 6 of the present application illustrates such prior art and shows a saw chain tensioning mechanism 50 incorporated in a chain saw 58 to adjust a longitudinal position of a chain guide plate 56 which has a rear end portion supported between a side case 52 and a main body case 54 through the use of a stud bolt 67 and a clamp nut 68, and protrudes frontward from the cases. The saw chain tensioning mechanism comprises a threaded rod member 62 having a first end formed with a tool insertion groove 60, and a pin member 64 adapted to be moved along the axial direction of the threaded rod member by a rotation of the threaded rod member so as to change the longitudinal position of the chain guide plate. The threaded rod member is provided with a driven bevel gear fixed to a second end thereof on the opposite side of the first end, and the driven bevel gear is engaged with a driving bevel gear having a shaft rotatably supported by the side case. Further, the shaft of the driving bevel gear is formed with a tool insertion groove 60*a* exposed outside the side case to allow an operator to perform an operation for rotating the threaded rod member using a tool from the side of the chain saw.

In the above conventional saw chain tensioning mechanism, the shaft or the threaded rod member has to be rotated using a tool. However, it is bothersome for an operator to always take along the tool. Moreover, if an operator forgets about taking along the tool, the adjustment cannot be performed in a working field. Thus, there is a need in the art for ways and mechanisms for adjusting tension in a saw chain without a tool.

SUMMARY

Accordingly, the present invention is directed to a saw chain tensioning mechanism without tool.

In one aspect of the invention, a saw chain tensioning mechanism for a chain saw, which has a chain guide plate for supporting a saw chain extending around the chain guide plate and a side case and a main body case for supporting the chain guide plate, includes a threaded rod member to be positioned adjacent to a rear end of the chain guide plate and along a longitudinal direction of the chain guide plate. The mechanism includes a movable member for engaging the chain guide plate and adapted to be moved along the threaded rod member by a rotation of the threaded rod member. A driven gear integral with the threaded rod member is rotatably driven by a driving gear, which is manually rotated by an operating member. A longitudinal position of the chain guide plate can thereby be changed to adjust a tension of the saw chain.

In another aspect of the invention, a chain saw includes a chain guide plate extending forward from a rear end thereof, a saw chain extending around the chain guide plate, a side case and a main body case. The chain guide plate is supported between the side case and the main body case, and a chain tensioning mechanism is provided adjacent the chain guide plate. The chain tensioning mechanism includes a threaded rod, a driven gear integral with the threaded rod, a movable member including a protruding member for engaging a receiving part of the chain guide plate and being adapted to move the chain guide plate relative the main body case and side case along a longitudinal direction of the chain guide plate in response to a rotation of the treaded rod. The mechanism also includes a manipulatable member for manually rotating a driving gear that drives the driven gear to thereby adjust a tension in the saw chain.

In a further aspect of the invention, a saw chain tensioning mechanism allows for manual adjustment of the tension of the saw chain without use of a tool.

BRIEF DESCRIPTION OF DRAWINGS

The accompanying drawings, which are included to provide a further understanding of the invention and are incorporated in and constitute a part of this specification, illustrate examples of the invention that together with the description serve to explain the principles of the invention. In the drawings.

DETAILED DESCRIPTION

These and other aspects of the invention will now be described in connection with an exemplary example illustrated in the accompanying drawings.

Figure 1:
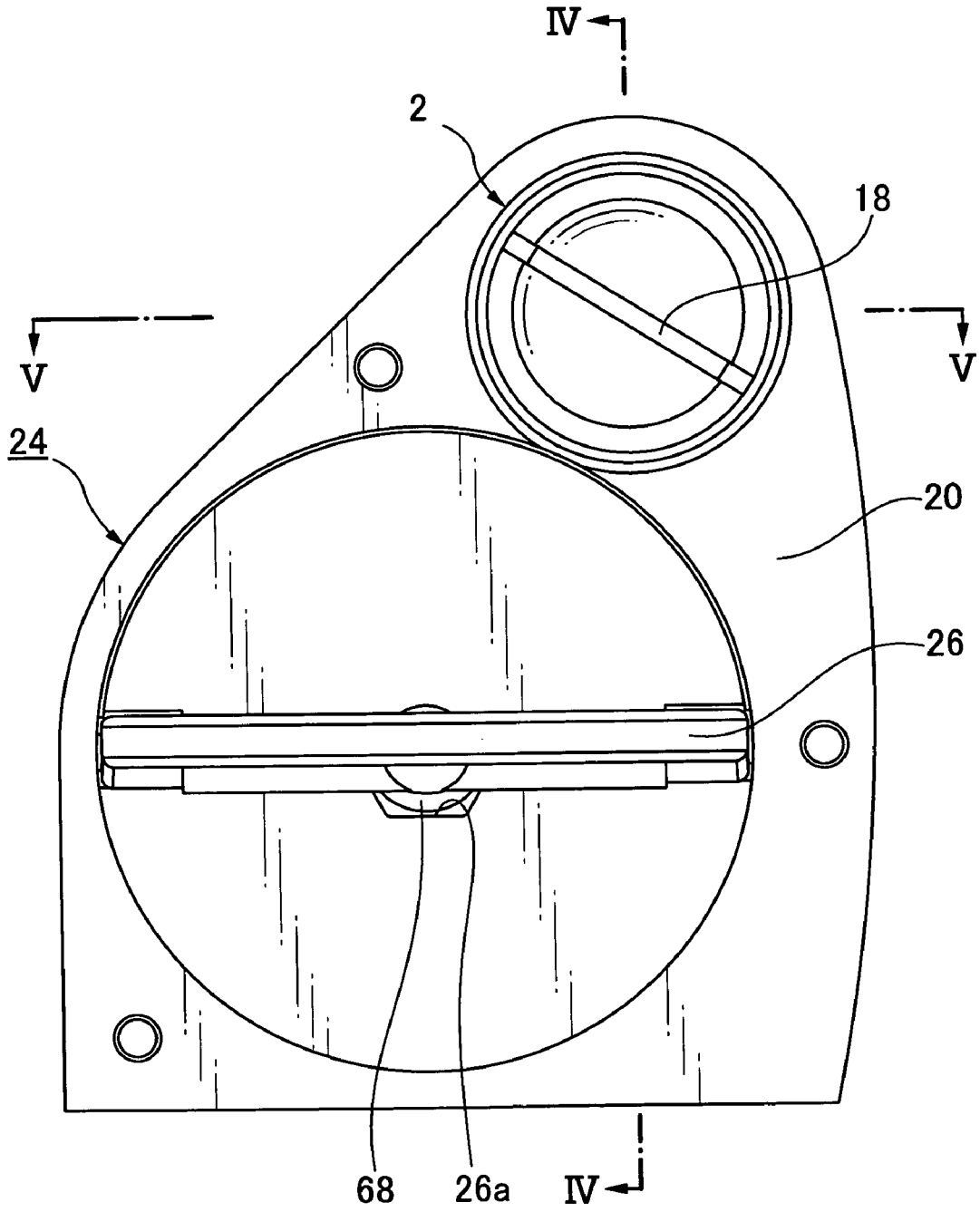
FIG. 1 is a front view of a saw chain tensioning mechanism according to an exemplary example of the present invention.
Figure 2:
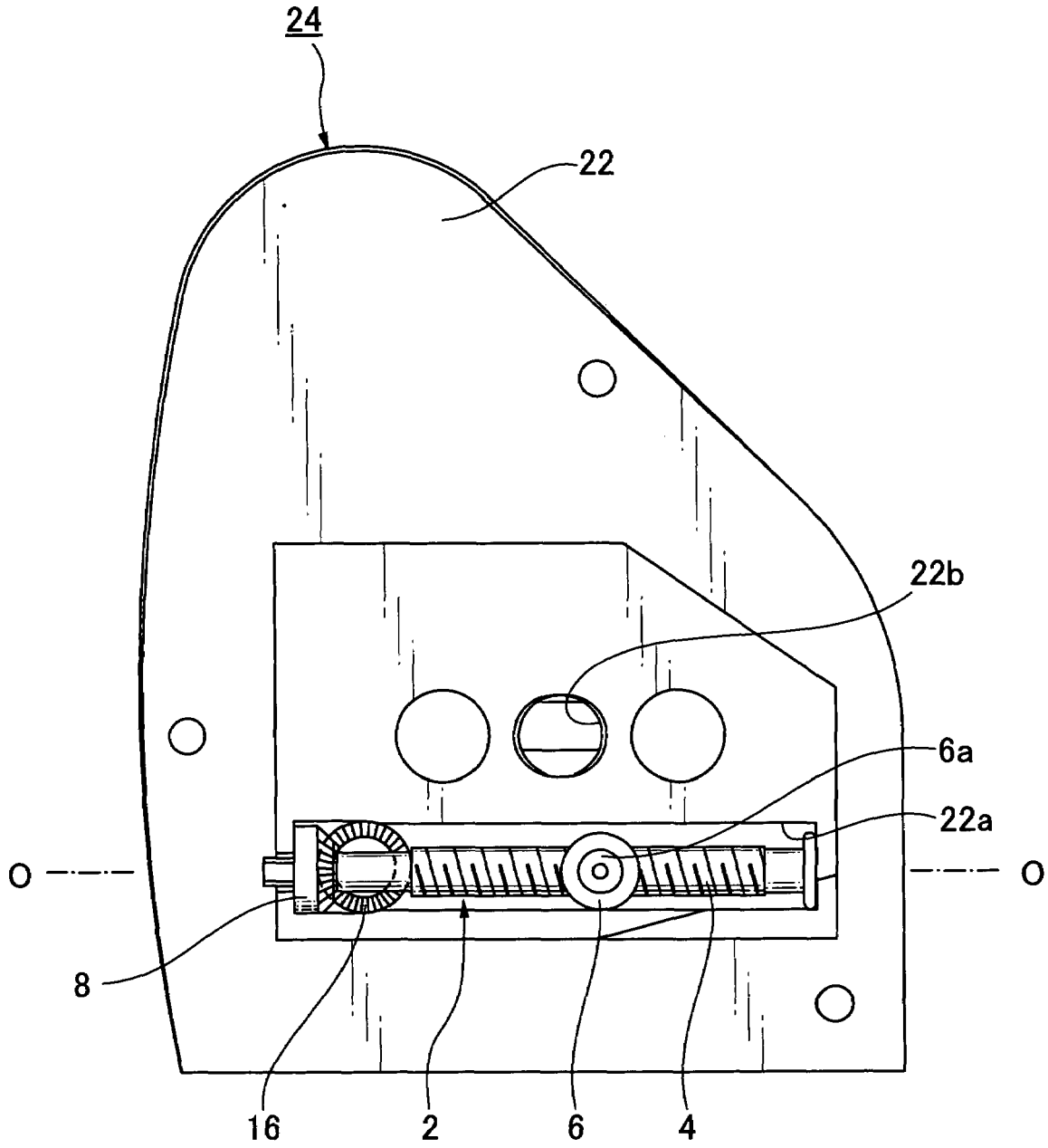
FIG. 2 is a back view of the exemplary saw chain tensioning mechanism of FIG. 1.
Figure 3:
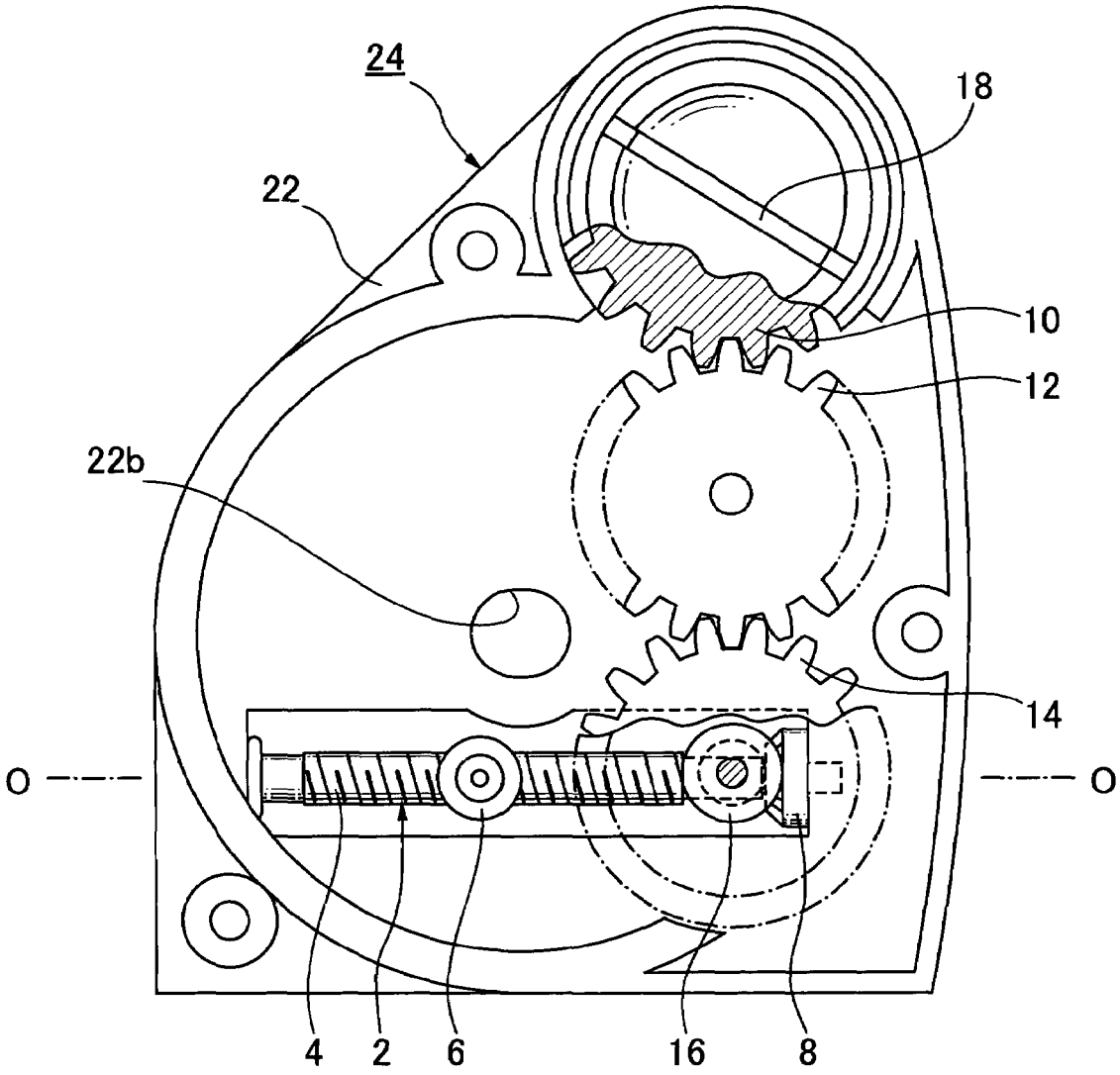
FIG. 3 is a partially broken view of the exemplary saw chain tensioning mechanism of FIG. 1, wherein a front side panel is removed.
Figure 4:
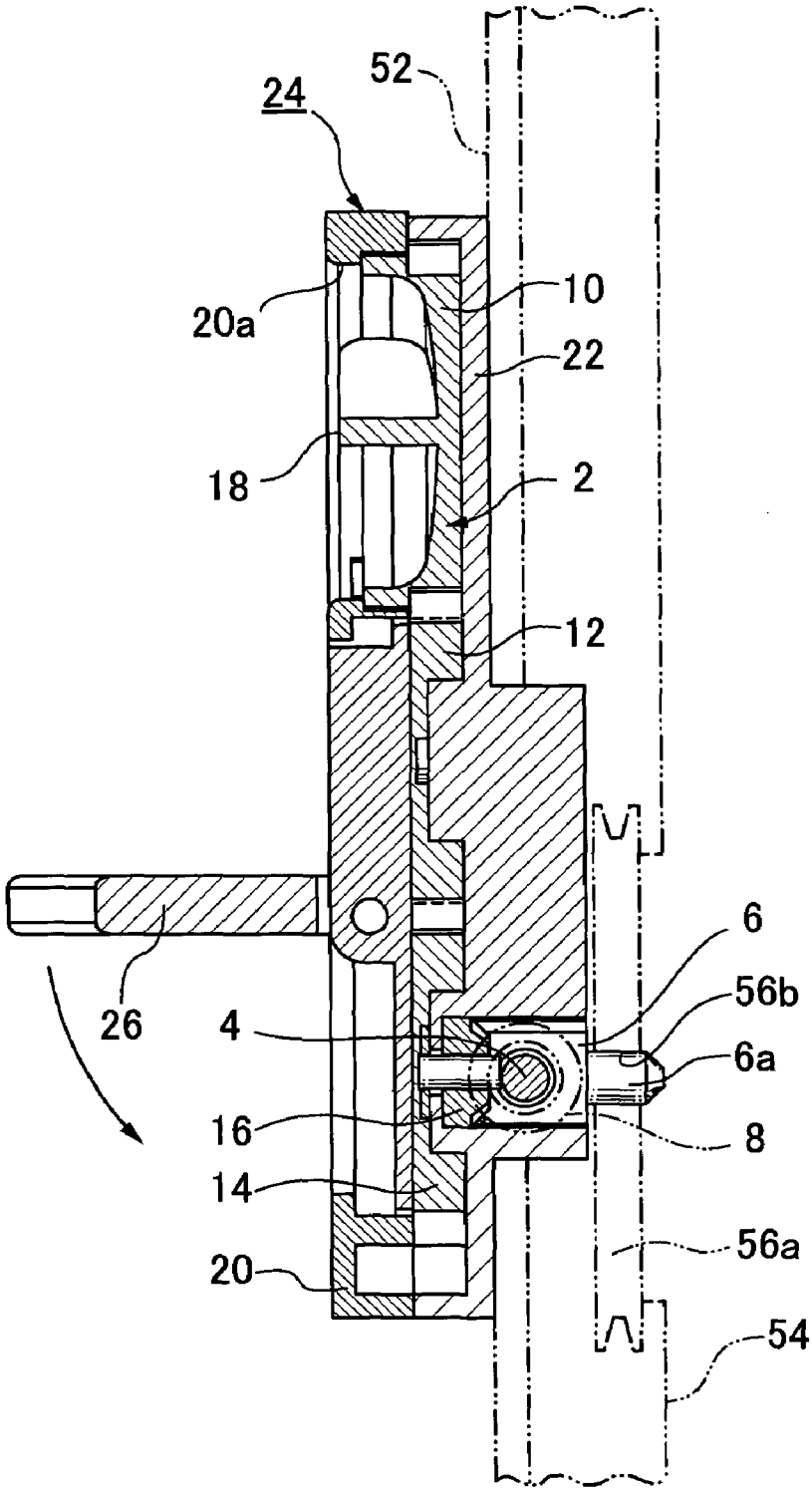
FIG. 4 is a sectional view taken along the line IV-IV in FIG. 1.
Figure 5:
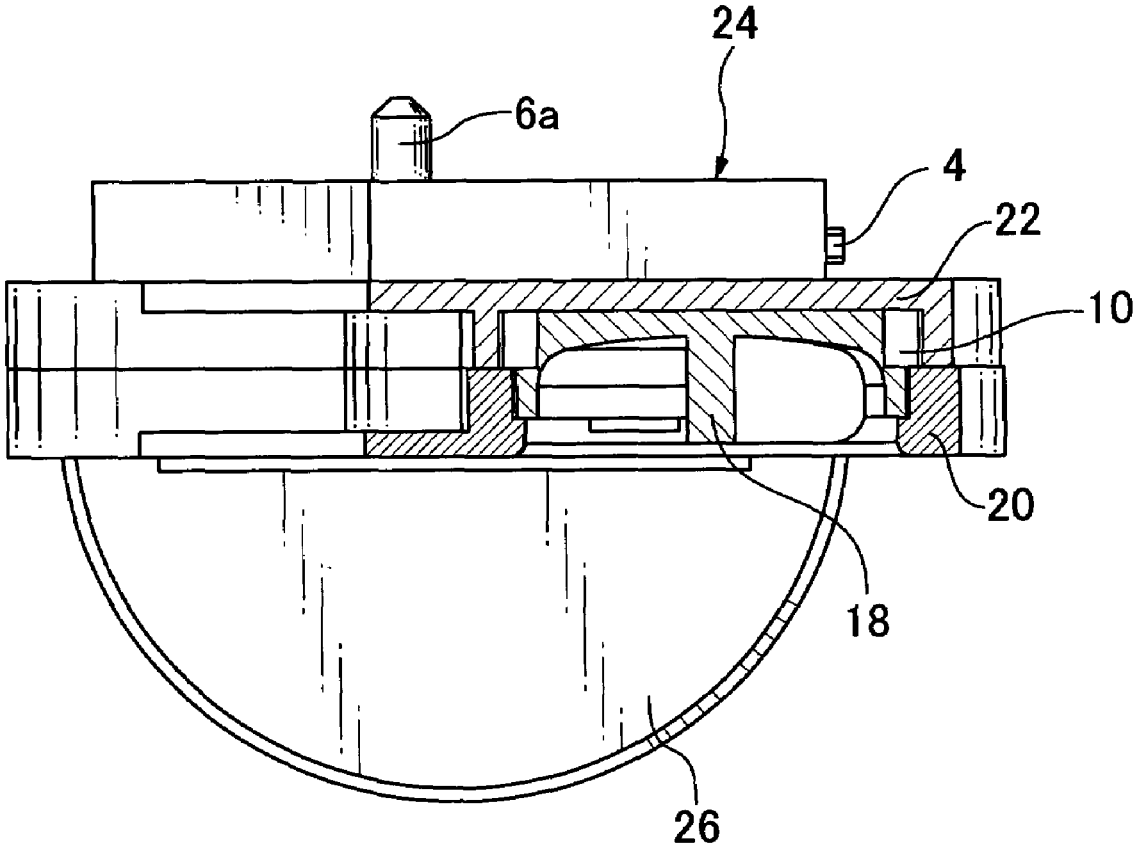
FIG. 5 is a sectional view taken along the line V-V in FIG. 1.

FIG. 1 is a front view of a saw chain tensioning mechanism according to an example of the invention, and FIG. 2 is a back view thereof. FIG. 3 is a partially broken view of the saw chain tensioning mechanism, wherein a front side panel is removed from the saw chain tensioning mechanism in FIG. 1. FIG. 4 is a sectional view taken along the line IV-IV in FIG. 1, and FIG. 5 is a sectional view taken along the line V-V in FIG. 1.

Figure 6:
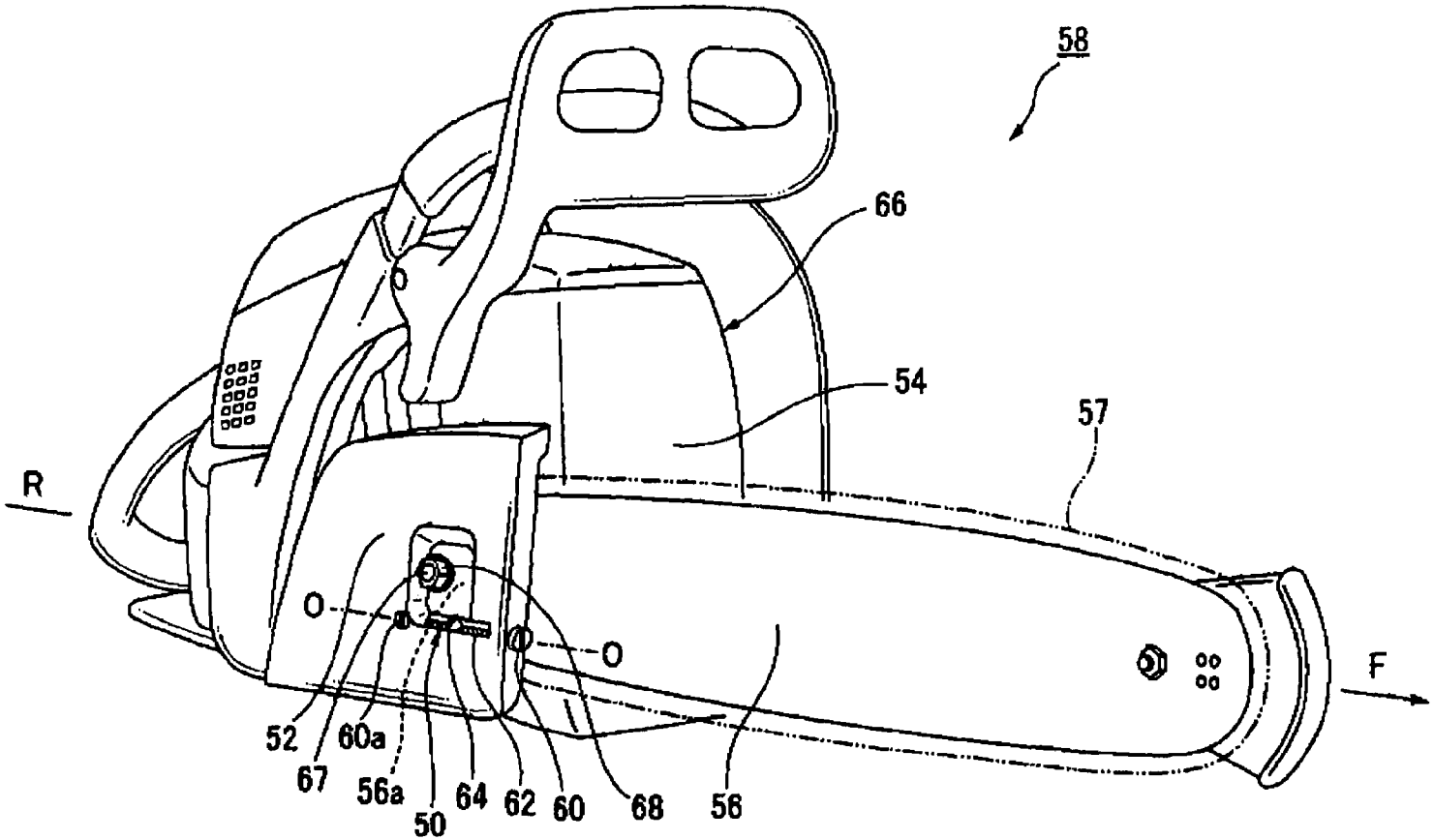
FIG. 6 is a perspective general view of a conventional chain saw incorporated with the saw chain tensioning mechanism.

The saw chain tensioning mechanism 2 according to this example is incorporated, for example, in a main body of the chain saw 58 or chain saw body 66 illustrated in FIG. 6. The chain saw body 66 includes a side case 52 detachably attached to an outer surface of the rear end portion 56*a* of the chain guide plate 56, and the saw chain tensioning mechanism 2 is disposed inside the side case 52 and in opposed relation to the rear end portion 56*a* of the chain guide plate 56.

As shown in FIG. 2, the saw chain tensioning mechanism 2 comprises a threaded rod member 4 disposed along the longitudinal direction of the chain guide plate 56, a threadingly engaged member 6 serving as a movable member threadingly engaged with the threaded rod member 4 and adapted to be moved along the threaded rod member 4 by a rotation of the threaded rod member 4, and a bevel gear 8 serving as a driven gear fixed to one end of the threaded rod member 4. As shown in FIG. 3, a driving gear 10 is provided for rotatively driving the driven bevel gear 8 by way of, for example, intermediate gears 12, 14 interposed between the driven bevel gear 8 and the driving gear 10. A chain-tensioning knob 18 serves as an operating member for manually rotating the driving gear 10. The driving gear 10 is formed as a spur gear, for example. The intermediate gear may include a first intermediate gear 12 formed as a spur gear engaged with the driving gear 10, and a second intermediate gear 14 formed as a spur gear engaged with the first intermediate gear 12. The second intermediate gear 14 is provided with a driving bevel gear 16 disposed concentrically therewith and adapted to be rotated together with the second intermediate gear 14. The driving bevel gear 16 is engaged with the driven bevel gear 8. The chain-tensioning knob 18 is disposed outside the side case 52 and coaxially fixed to the driving gear 10 in a rotatable manner. Thus, an operator can hold and rotate the chain-tensioning knob 18 by his/her fingers without detaching the side case 52.

The threadingly engaged member 6 has an engaging portion 6*a* for protruding toward the inside of the chain-saw body 66 and connecting with the chain guide plate 56. For example, the engaging portion 6*a* can be a pin-shaped portion fitted into a hole 56*b* formed in the chain guide plate 56, as shown in FIG. 4.

As shown in FIGS. 1 and 2, the saw chain tensioning mechanism 2 is disposed between a first side panel 20 located on the outward side (on the basis, for example, of the chain-saw body 66 of FIG. 6 when it is attached to the side case 52 of the chain-saw body 66), and a second side panel 22 located on the inward side (on the basis of the chain-saw body 66 when it is attached to the side case 52 of the chain-saw body 66), which are combined together in opposed relation to one another. The saw chain tensioning mechanism 2 is supported and packaged by the first and second side panels 20, 22 to form a saw chain tensioning assembly 24. The second side panel 22 is formed with a window 22*a* extending in the longitudinal direction of the chain guide plate 56, and all of the threaded rod member 4, the threadingly engaged member 6 and the driven bevel gear 8 may be disposed in the window 22*a*. The exemplary pin-shaped engaging portion 6*a* protrudes from the second side panel 22 toward the inside of the chain saw body 66.

With reference to FIGS. 4 and 6, in the state after the saw chain tensioning assembly 24 is attached to the chain saw body 66, the second side panel 22 is in contact with an outer surface of the chain guide plate 56, and the engaging portion 6*a* is inserted into a receiving portion 56*b* of the chain guide plate 56. For example, the pin-shaped engaging portion 6*a* is inserted into the hole 56*b* of the chain guide plate 56. The first side panel 20 is formed with a hole 20*a* for exposing the chain tensioning knob 18 outside, and the chain tensioning knob 18 is received in the hole 20*a*. As previously mentioned, the side case 52 is located on the side of the second side panel 22. The driving gear 10, the first intermediate gear 12 and the second intermediate gear 14 are aligned along the first and second side panels 20, 22 or along the side case 52.

Although not shown in the figures, a pair of side plates are disposed, respectively, on opposite sides of the chain guide plate 56 to prevent the saw chain 57 from getting away from the chain guide plate 56. These side plates are fixedly fastened together by the side case 52, a fixed stud bolt 67 and a clamp nut 68 so as to allow the chain guide plate 56 to be sandwiched therebetween. In FIG. 1, an additional knob 26 disposed below the chain-tensioning knob 18 is provided as a means to manually tighten or loosen the clamp nut 68. Specifically, the first and second side panels 20, 22 are formed with a stud-bolt penetration hole 22*b* for allowing the tip of the stud bolt 67 to protrude outward therefrom as shown in FIG. 2, and the first side panel 20 is formed with a fitting portion 26*a* for receiving the nut 68 therein, at the rotation center of the nut adjusting knob 26. In the state after the saw chain tensioning assembly 24 is attached to the chain-saw body 66, the nut 68 is received in the fitting portion 26*a*, and an operator can manually rotate the nut-adjusting knob 26 to tighten or loosen the nut 68.

The saw chain tensioning mechanism 2 is operated as follows.

When it is necessary to increase the tension of the saw chain 57, the nut-adjusting knob 26 is pulled out as shown in FIG. 1, and rotated in a first direction to loosen the nut 68. Then, when the chain-tensioning knob 18 is rotated in a first direction, the threaded rod member 4 is rotated through the first and second intermediate gears 12, 14, the driving bevel gear 16, and the driven bevel gear 8. Thus, the threadingly engaged member 6 is moved frontward (rightward in FIG. 3), and thereby the chain guide plate 56 is moved frontward (F) relative to the chain-saw body 66. Through this operation, the saw chain 57 wound around the chain guide plate 56 can have an increased tension. After a desired tension is obtained, the nut adjusting knob 26 is rotated in a second or opposite direction to sufficiently tighten the nut 68, and then turned down to activate appropriate detent means (not shown) so as to fix the longitudinal position (F-R) of the chain guide plate 56. If the chain-tensioning knob 18 is rotated in a second or opposite direction, the chain guide plate 56 will be moved in the opposite direction or rearward (R) relative to the chain-saw body 66 to reduce the tension of the saw chain 57.

In this example, each of the driving gear 10 and the intermediate gears 12, 14 is formed as a spur gear, and aligned along the side case 52. This makes it possible to achieve reduction in thickness and size of the saw chain tensioning mechanism 2 in its entirety. In addition, the chain-tensioning knob 18 is received in the hole 20*a* of the first side panel 20, and the nut-adjusting knob 26 has a foldable structure capable of avoiding sticking out. This facilitates further downsizing.

Further, the intermediate gears 12, 14 interposed between the driving gear 10 and the driven bevel gear 8 makes it possible to avoid a physical interference between the chain tensioning knob 18 and the nut adjusting knob 26 required to be disposed adjacent to the nut 68.

It is to be understood that the present invention is not limited to the above example, but various changes and modifications may be made therein without departing from the spirit and scope thereof as set forth in appended claims, all of which are intended to be encompassed within the scope thereof.

For example, while the intermediate gear 12, 14 is effective in avoiding the physical interference between the chain tensioning knob 18 and the nut adjusting knob 26, such feature is not essential in arrangements where such interference does not present a problem. For instance, the driven bevel gear 8 may be driven directly by the driving gear 10.

Further, it is to be understood that the saw chain tensioning mechanism may be integrally attached to the side case 52 without being formed as the saw chain tensioning assembly 24.

Furthermore, the driven gear 8 and the driving gear 18 are not limited to a combination of bevel gears, but may be a combination of helical gears.

Thus, it is intended that the present invention cover the modifications of this invention provided they come within the scope of the appended claims and their equivalents.

What is claimed is:

1. A saw chain tensioning mechanism for adjusting a tension of a saw chain of a chain saw, said chain saw including a chain guide plate for supporting a saw chain extending around said chain guide plate and a side case and a main body case for supporting the chain guide plate in a sandwiched manner therebetween, said saw chain tensioning mechanism comprising:

a threaded rod member for positioning adjacent to a rear end of said chain guide plate and along a longitudinal direction of said chain guide plate;

a movable member for engaging said chain guide plate and adapted to be moved along said threaded rod member by a rotation of said threaded rod member;

a driven gear integral with said threaded rod member;

a driving gear for rotatably driving said driven gear;

a first knob for manually rotating said driving gear, whereby a longitudinal position of said chain guide plate is changed to adjust a tension of said saw chain;

a second knob for manually tightening and loosening said side case and said main body case about said chain guide plate; and an intermediate gear interposed between said driving gear and said driven gear;

wherein each of said driving gear and said intermediate gear is formed as a spur gear arranged to be aligned along said side case.

2. The saw chain tensioning mechanism as defined in claim 1, wherein said driven gear is formed as a bevel gear.

3. The saw chain tensioning mechanism as defined in claim 1, wherein said driven gear is formed as a bevel gear.

4. The saw chain tensioning mechanism of claim 3, wherein said second knob comprises a retractable portion.

5. A chain saw comprising:

a main body case;

a side case;

a chain guide plate extending from the main body case and supported between the side case and the main body case;

a saw chain extending around said chain guide plate; and a chain-tensioning mechanism adjacent said chain guide plate, wherein the chain-tensioning mechanism comprises:

a threaded rod;

a driven gear integral with the threaded rod;

a movable member including a protruding member for engaging a receiving part of the chain guide plate and adapted to move the chain guide plate relative the main body case and the side case along a longitudinal direction of the chain guide plate in response to a rotation of the threaded rod;

a first knob, which when manually rotated, causes a rotation of a driving gear to drive the driven gear and thereby adjust a tension in the saw chain;

a second knob for manually tightening and loosening said side case and said main body case about said chain guide plate; and an intermediate gear interposed between said driving gear and said driven gear;

wherein each of sand driving gear and said intermediate gear is formed as a spur gear aligned along said side case.

6. The chain saw according to claim 5, wherein the axis of rotation of the first knob is substantially perpendicular to the longitudinal direction.

7. The chain saw according to claim 5, wherein said driving gear directly drives said driven gear.

8. The chain saw according to claim 5, wherein said driven gear is formed as a bevel gear.

9. The chain saw according to claim 5, wherein said second knob comprises a retractable portion.

* * * * *